US007854036B2

(12) United States Patent
Georgi

(10) Patent No.: US 7,854,036 B2
(45) Date of Patent: Dec. 21, 2010

(54) TOOTHBRUSH

(75) Inventor: Matthias Georgi, Buehl (DE)

(73) Assignee: GlaxoSmithKline Consumer Healthcare GmbH & Co. KG, Bussmatten (DE)

( * ) Notice: Subject to any disclaimer, the term of this patent is extended or adjusted under 35 U.S.C. 154(b) by 438 days.

(21) Appl. No.: 10/542,747

(22) PCT Filed: Jan. 19, 2004

(86) PCT No.: PCT/EP2004/000665

§ 371 (c)(1),
(2), (4) Date: Mar. 24, 2006

(87) PCT Pub. No.: WO2004/064573

PCT Pub. Date: Aug. 5, 2004

(65) Prior Publication Data

US 2006/0236482 A1 Oct. 26, 2006

(30) Foreign Application Priority Data

Jan. 20, 2003 (GB) ..... 0301248.1
Jul. 25, 2003 (GB) ..... 0317494.3

(51) Int. Cl.
*A46B 9/04* (2006.01)

(52) U.S. Cl. ..... 15/167.1; 15/207.2

(58) Field of Classification Search ..... 15/167.1, 15/207.2

See application file for complete search history.

(56) References Cited

U.S. PATENT DOCUMENTS

| | | | | |
|---|---|---|---|---|
| 2,242,743 A | | 5/1941 | Brown | |
| 2,317,485 A | * | 4/1943 | Rider | 15/167.1 |
| 2,643,158 A | | 6/1953 | Baldanza | |
| 3,085,273 A | | 4/1963 | Cowan | |
| 3,691,585 A | | 9/1972 | Flom | |
| 4,493,125 A | | 1/1985 | Collis | |
| 5,274,873 A | | 1/1994 | Shields | |
| 5,823,633 A | | 10/1998 | Weihrauch | |
| 5,926,898 A | | 7/1999 | Kramer | |
| 5,926,900 A | | 7/1999 | Bennett | |
| 6,088,869 A | * | 7/2000 | Kaneda et al. | 15/167.1 |
| 6,314,605 B1 | * | 11/2001 | Solanki et al. | 15/167.1 |
| 2002/0056941 A1 | | 5/2002 | Buchholz | |

FOREIGN PATENT DOCUMENTS

| | | |
|---|---|---|
| DE | 4415886 | 11/1995 |
| EP | 0197384 | 10/1986 |
| EP | 0326634 | 8/1989 |
| EP | 0336641 | 11/1989 |
| EP | 0346646 | 12/1989 |
| GB | 1082649 A | 9/1967 |
| GB | 1098933 | 1/1968 |
| WO | WO96/25866 | 8/1996 |
| WO | WO97/07707 | 3/1997 |
| WO | WO97/24949 | 7/1997 |
| WO | WO98/37788 | 9/1998 |

* cited by examiner

*Primary Examiner*—Laura C Guidotti
(74) *Attorney, Agent, or Firm*—Joshua C. Sanders; Nora Stein; Theodore R. Furman

(57) ABSTRACT

A toothbrush head having an undulating surface with at least one more displaced part and at least one less displaced part and with bristles having a triangular cross section extending from a more displaced part of the bristle face.

14 Claims, 5 Drawing Sheets

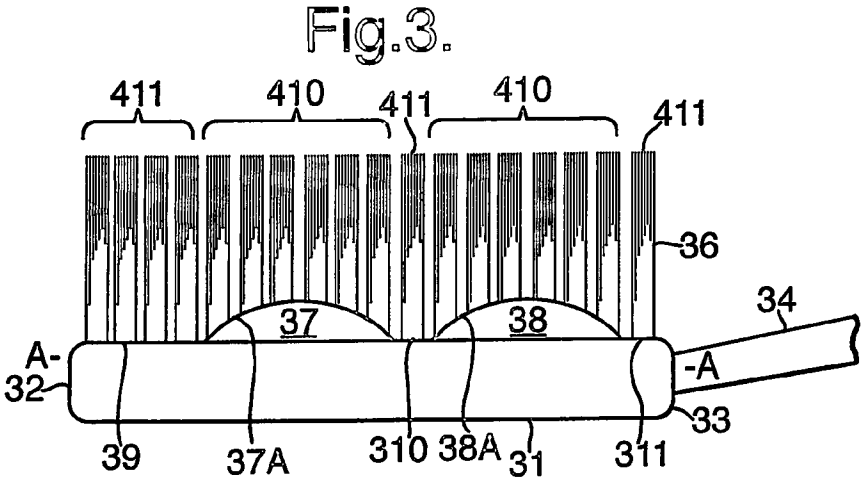
Fig.4.
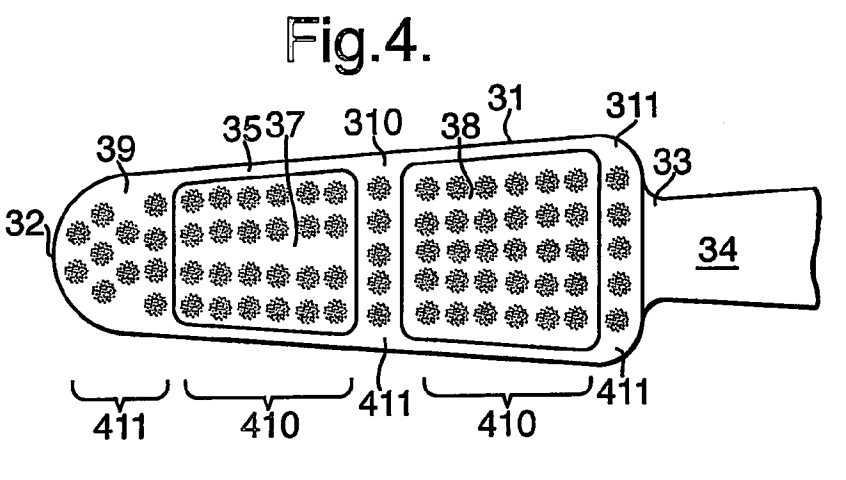
Fig.6.
Fig.3.
Fig.5.

TOOTHBRUSH

This application is a 371 National Phase entry of international application number PCT/EP2004/000665, filed Jan. 19, 2004.

This invention relates to toothbrushes, in particular to toothbrush heads having an undulating bristle face and bristles of a triangular cross section.

BACKGROUND OF THE INVENTION

Generally a toothbrush has a head and a handle disposed along a longitudinal axis, the head having bristles arranged in tufts extending from a face thereof ("the bristle face") in a general bristle direction. It is known, e.g. in British Standards Institution publication BS 5757:1979 "Specification for Toothbrushes" that the stiffness of a toothbrush bristle is related to its length and diameter. For bristles of the same diameter and material, longer bristles will be less stiff than shorter bristles.

Generally the bristle face is planar. Toothbrushes are disclosed in inter alia WO 96/25866, GB 1098933, JP-UM-51-129261 and JP-UM-1-155825 in which the bristle face is longitudinally undulating.

Toothbrush bristles are normally mounted on the toothbrush head packed together in tufts. Generally toothbrush bristles are filaments of a polymeric material such as the well known Tynex™ bristles made of nylon, and have a circular cross section. Toothbrush bristles of other cross sections are also known e.g. having a triangular cross section, e.g. see U.S. Pat. No. 4,493,125. Triangular cross section bristles have the advantage that they can penetrate the interproximal spaces between the teeth better than circular section tufts, and also they can be packed together more densely than circular sectioned bristles in a tuft as triangular shapes fit together without the interstitial voids that form between packed circular shapes. However triangular sectioned bristles are generally made of a smaller cross sectional area than circular sectioned bristles so are generally less stiff than circular sectioned bristles of the same length. This can be detrimental to their effectiveness in penetrating the interproximal spaces.

It is an object of the present invention is to provide a construction of toothbrush head which enables the effectiveness of triangular bristles in penetrating the interproximal spaces to be exploited, whilst improving the stiffness of such bristles relative to circular sectioned bristles.

SUMMARY OF THE INVENTION

According to this invention, a toothbrush head, connected to or connectable to a toothbrush handle, and which is elongated along a head longitudinal direction and has a bristle face from which bristles extend in a bristle direction, the bristle face having an undulating surface that varies, with longitudinal distance along the head, in its displacement distance in a direction perpendicular to a plane passing through the head parallel to its longitudinal direction, so that there is at least one more displaced part and at least one less displaced part, is provided and is characterised in that bristles having a triangular cross section extend from a more displaced part of the bristle face.

The bristle face may be displaced in the direction perpendicular to the plane, i.e. in the bristle direction, to form a more displaced part in various ways.

DETAILED DESCRIPTION OF THE INVENTION

For example the bristle face may comprise one, or more than one, more displaced part comprising one or more widthways aligned ridge descending longitudinally to a less displaced part on each longitudinal side of the ridge. Such a ridge may be rounded in profile, e.g. a part-circular or part-oval curve as sectioned longitudinally. Alternatively such a ridge may have a triangular or wedge-shaped profile as sectioned longitudinally. For example the bristle face may have a domed, conical or pyramidal surface with the surface descending away longitudinally to a less displaced part on each longitudinal side of the more displaced part.

A particular profile of a more displaced part is a ridge which in plan looking down on the bristle face perpendicular to the longitudinal direction is a curved, e.g. crescentic or part circular curved, shape with its cusps on opposite sides of the longitudinal axis of the head, for example with its convex bulge facing away from the handle.

Another particular profile of a more displaced part is a ridge which in plan looking down on the bristle face perpendicular to the longitudinal direction is a "V" or chevron shape with its apex pointing away from the handle.

Such a curved or "V" plan ridge may in section be rounded or triangular shaped.

A less displaced part may for example comprise a flat part of the head longitudinally adjacent to a more displaced part. Preferably a less displaced part may be provided longitudinally between two more displaced parts, e.g. as a valley longitudinally between two ridges.

For example the bristle face may have a longitudinally undulating, e.g. sinusoidal, zigzag or other wave-form profile of two or more alternating more displaced parts, with a valley, i.e. less displaced part, arranged longitudinally between each longitudinally adjacent pair of more displaced parts. The descent from the more displaced part, or the ascent up from the less displaced part may be by a planar or curved slope, or stepwise.

Alternative constructions will be apparent to those skilled in the art.

Preferably the variation in displacement of the bristle face with the longitudinal distance forms a longitudinally undulating shape. Only the bristle face need be undulating, although the entire head of the toothbrush including the opposite face may be displaced perpendicular to the plane in a manner corresponding to the bristle face.

Preferably there are at least two more displaced parts, with a less displaced part longitudinally in between. The head has a base end closest to the toothbrush handle and an opposite tip end, and preferably there is a less displaced part adjacent to one or both of the base end and tip end.

A preferred arrangement of more and less displaced parts comprises: a first less displaced part adjacent the end of the head furthest from the handle (the "tip end"), a first more displaced part longitudinally adjacent to this first less displaced part and closer to the handle, a second less displaced part longitudinally adjacent the first more displaced part and closer to the handle, a second more displaced part longitudinally adjacent to this second less displaced part and closer to the handle so that the second less displaced part is longitudinally between the first and second more displaced parts, and a third less displaced part longitudinally adjacent the second more displaced part and closest to the handle.

Preferably the longitudinal spacing of the most displaced parts of such at least two more displaced parts corresponds approximately to the spacing between the interproximal spaces of adjacent teeth, and this is conveniently achieved using the arrangements of more and less displaced parts discussed above. Such a spacing can help to direct the triangular sectioned bristles into the interproximal spaces.

Typically the variation in displacement distance between more and less displaced parts may be 1-3 mm, e.g. 1.5 mm+/−20%.

The triangular sectioned bristles may have an equilateral or isosceles triangular section, or all of the sides may be different lengths. The term "triangular" includes triangular shapes with convex or concave curved sides and rounded apexes.

On the surface the bristles may be disposed in plural tufts each containing plural bristles. Such tufts may be disposed in generally longitudinally aligned rows of tufts, which need not be exactly parallel to the longitudinal direction.

The triangular sectioned bristles extend from one or more of the more displaced part(s) of the bristle face. Such bristles may extend from the most displaced part of a more displaced part, and may also extend from a part of the more displaced part between the most displaced part and the less displaced part, e.g. from the part of a more displaced part which descends toward a less displaced part. Triangular sectioned bristles may extend only from the more displaced parts. Triangular sectioned bristles may also extend from a less displaced part of the bristle face.

Preferably bristles having a round cross section extend from a less displaced part of the bristle face, e.g. from all of the less displaced parts.

The ends of the bristles remote from the bristle face may occupy an undulating e.g. longitudinally undulating profile.

An example of such an undulating profile is one in which the ends of the bristles occupy two height levels from the face, being a first greater height and a second lower height, with groups of tufts having their ends longitudinally alternatingly at the first or second height. For example tufts of the first height may extend from the more displaced parts, and tufts of the second height may extend from less displaced parts. For example a tuft or group of tufts furthest from the handle may have the first, greater height. Typically toothbrush bristles have a length 10-12 mm between the bristle face and the ends of the bristles, and the difference between the first and second height may be ca. 1.0-1.5 mm.

Alternatively the length of the bristles may all be the same so that the ends of the bristles remote from the bristle face follow a profile corresponding to the bristle face.

Alternatively the length of the bristles may vary in direct inverse proportion to their displacement distance so that the ends of the bristles remote from the bristle face follow a planar profile.

Alternatively bristles extending from a more displaced part may be shorter than the bristles which extend from a less displaced part, to the extent that the ends of the bristles remote from the bristle face follow a profile having a concavity adjacent to a more displaced part.

Alternatively bristles extending from a more displaced part may be the same length as, shorter, or longer than the bristles which extend from a less displaced part, to the extent that the ends of the bristles remote from the bristle face follow a profile having a convexity adjacent to a more displaced part. However if the ends of the bristles remote from the bristle face follow a profile having a convexity adjacent to a more displaced part then preferably the length of the bristles extending from the more displaced part(s), e.g. the triangular section bristles, is less than the length of the bristles extending from the less displaced part(s).

Suitably the bristles extend from the bristle face in a bristle direction substantially perpendicular to the bristle face.

Alternatively bristles may be at a non-perpendicular angle to the bristle face. For example bristles may be arranged in longitudinally aligned rows of longitudinally sequential tufts, and the tufts in one such row may lean so that their ends remote from the face are closer to the tip end, and tufts in a widthways adjacent row may lean in the opposite way, so that as seen looking across the longitudinal direction the widthways adjacent rows appear to cross in an "X" shape. Leaning tufts arranged in this "crossed" way are known in the field e.g. from U.S. Pat. No. 5,274,873, U.S. Pat. No. 3,085,273 and U.S. Pat. No. 2,242,743. Leaning tufts in this way helps to guide them into the interproximal spaces.

The bristles may be arranged in discrete tufts which may be circular cross section perpendicular to the bristle direction.

Alternatively the bristles may be arranged in one or more tuft of non circular section as cut perpendicular to the bristle direction, for example of elongated section, e.g. oval, rectangular optionally with rounded ends, or linear. For example such an elongated section tuft may be elongated along the longitudinal direction or across the width of the surface of the bristle face. For example such an elongated section tuft may have a section elongated along the longitudinal direction and may extend from a more displaced part such that along the length of the elongated section of the tuft the displacement distance of the bristle face varies.

The stiffness of toothbrush bristles is influenced by their length, so that for bristles of the same cross section, longer bristles are less stiff, and conversely shorter bristles of smaller cross section can be made of comparable stiffness to longer bristles of a larger cross section. Therefore although bristles of triangular cross section are generally made with a cross section less than bristles of a round cross section, by locating the bristles of triangular section on a more displaced part they may be made shorter than bristles of a round cross section located at a less displaced part, but may be of similar stiffness.

Also in an elongated section tuft with a section elongated along the longitudinal direction and which extends from a more displaced part such that along the length of the elongated section of the tuft the displacement distance of the bristle face varies, the length of the bristles may also vary along the length of the more displaced part, so that the stiffness of the bristles may also vary along the length of the more displaced part. For example there may be longer, less stiff, bristles at a least displaced part of a more displaced part, and shorter, stiffer, bristles at a most displaced part of a more displaced part. For example there may be longer, less stiff, bristles at the longitudinal ends of a more displaced part, and shorter, stiffer, bristles at the longitudinal mid point of a more displaced part.

Tufts of bristles may be fastened into the toothbrush head in conventional ways, for example with conventional small metal clips. Preferably the tufts may be welded into the toothbrush head. A particularly preferred method for the fastening of tufts which are of non-circular cross section is that of moulding the plastics material of the head of the toothbrush around the ends of the tufts to be fastened into the head during the process of injection moulding manufacture of the head. Methods of welding in the tufts and/or tufts are for example disclosed in U.S. Pat. No. 2,643,158, DE-A-44 15 886A, EP-A-0326634A, EP-A-0346646A, U.S. Pat. No. 5,823,633, US-A-2002/0056941 and EP-A-0197384A amongst other publications.

The invention also provides a toothbrush having a toothbrush head as described herein, and a grip handle, with a neck between the head and handle. The head may be integrally permanently connected to the handle or replaceably connected. The toothbrush of the invention may include other known features of toothbrushes such as the "V" shaped folds of EP 0336641A or the flexible link between the head and the neck of WO 9724949, or the flexible tip of WO 9707707, or the combination of flexible tip and flexible link between the head and handle of WO 9837788.

The toothbrush may be made out of materials conventional in the art of toothbrushes, e.g. plastics materials, and may be made by conventional plastics moulding techniques.

BRIEF DESCRIPTION OF THE DRAWINGS

The invention will now be described by way of example only with reference to the following drawings.

FIG. 3 Shows a sideways view of a toothbrush head of this invention.

FIG. 4 Shows a plan view of the toothbrush head of FIG. 3.

FIG. 5 Shows a sideways view of another toothbrush head of this invention.

FIG. 6 Shows a plan view of the toothbrush head of FIG. 4.

Referring to FIG. 1 bristles 10 of circular section are shown packed together to form a circular sectioned tuft 11 containing plural bristles 10. It is seen there are voids 12 between the bristles 10, making up a substantial proportion of the internal volume of the tuft 11.

Referring to FIG. 2 bristles 20 of triangular section are shown packed together to form a circular sectioned tuft 21 containing plural bristles 10. It is seen there are no, or only very small voids 22 between the bristles 20, so that there is little empty space in the internal volume of the tuft 21.

Referring to FIGS. 3 and 4 a toothbrush head 31 is shown in side view, having a tip end 32 and a base end 33 at which it is integrally formed into a neck 34 by which it is integrally connected to a handle (not shown). The head 31 is elongated along a longitudinal direction A—A and has a bristle face 35 from which bristles 36 extend in a bristle direction B perpendicular to the longitudinal direction A—A.

The bristle face 35 has an undulating surface that varies with distance along the length A—A of the head 31 in its displacement distance perpendicular to a plane passing through the head 31 parallel to its longitudinal direction A—A. As seen in FIGS. 3 and 4 this plane is also perpendicular to the bristle direction B. This is achieved by the bristle face 35 comprising two widthways aligned ridges 37, 38 each descending longitudinally to a less displaced part 39, 310, 311 on each longitudinal side of the ridge. The ridges 37, 38 are rounded in profile in a part-circular curve as sectioned longitudinally. The less displaced parts 39, 310, 311 comprise flat parts of the bristle face 35 adjacent to the more displaced parts 37, 38. The less displaced part 310 is longitudinally between the two more displaced parts 37, 38 as a valley longitudinally between these two ridges. The descent from the more displaced parts 37, 38, and hence the ascent up from the less displaced parts 39, 310, 311 is by curved slopes e.g. 37A, 38A.

Figure 2:
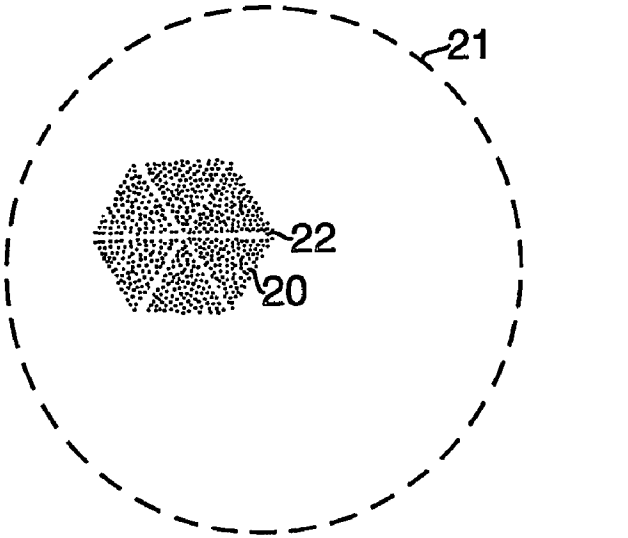
FIG. 2 Shows a cross section through a circular section tuft containing triangular section bristles.

The arrangement of more and less displaced parts shown in FIG. 3 therefore comprises a first less displaced part 39 adjacent the tip end 32 of the head 31, a first more displaced part 37 longitudinally adjacent to this first less displaced part 39 and closer to the handle, a second less displaced part 310 adjacent the first more displaced part 37 and closer to the handle, a second more displaced part 38 longitudinally adjacent to this second less displaced part 310 and closer to the handle so that the second less displaced part 310 is longitudinally between the first 37 and second 38 more displaced parts, and a third less displaced part 311 longitudinally adjacent the second more displaced part 38 and closer to the handle. The longitudinal spacing of the most displaced parts of the two more displaced parts 37, 38, i.e. the tops of the ridges 37, 38, corresponds approximately to the spacing between the interproximal spaces of adjacent teeth.

The height of the two more displaced parts 37, 38 relative to the less displaced parts 39, 310, 311 is ca. 1-3 mm.

Figure 1:
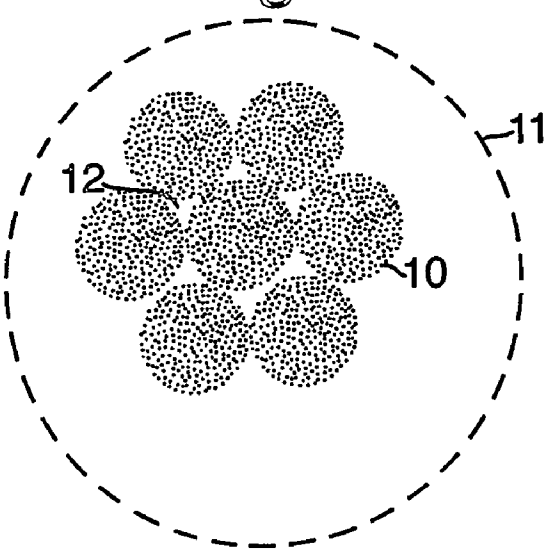
FIG. 1 Shows a cross section through a circular section tuft containing circular section bristles.

The bristles 36 are disposed in circular sectioned tufts 410 containing plural bristles as seen more clearly in the plan view of FIG. 4. The tufts 410 extending from the more displaced parts 37, 38 are composed of bristles having a triangular cross section, i.e. as shown in FIG. 2. The tufts 411 extending from the less displaced parts 39, 310, 311 are composed of bristles having a circular cross section, i.e. as shown in FIG. 1. The tufts 411 are arranged in a polygonal cluster on the less displaced part 39, and in widthways aligned rows on the less displaced parts 310, 311.

The length of the bristles 36 vary in direct inverse proportion to their displacement distance from the plane, i.e. shorter bristles 410 are located on the more displaced parts 37, 38 and longer bristles 411 on the less displaced parts 39, 310, 311 so that the ends of the bristles 36 remote from the bristle face 35 follow a planar profile.

Referring to FIGS. 5 and 6 a toothbrush head 51 is shown of similar construction to the head of FIGS. 3 and 4. However in the head of FIGS. 5 and 6 the bristles on the more displaced parts 37, 38 are arranged in tufts 510 of non circular section perpendicular to the bristle direction, being of an elongated rectangular section with rounded ends, elongated along the longitudinal direction A—A. These elongated section tufts 510 are of such a length that along the length of the elongated section of the tuft 510 the displacement distance of the bristle face varies 35, being greater at the longitudinal mid-point of the tuft 510 than at the ends of the tuft 510. Consequently, the bristles at the longitudinal mid-point of the tuft 510 are stiffer than those at the ends of the tuft 510. The tufts 510 extending from the more displaced parts 37, 38 are composed of bristles having a triangular cross section, i.e. as shown in FIG. 2.

The tufts 511 extending from the less displaced parts 39, 310, 311 are composed of bristles having a circular cross section, i.e. as shown in FIG. 1. The tufts 511 are arranged in a polygonal cluster on the less displaced part 39, and in widthways aligned rows on the less displaced parts 310, 311.

The length of the shortest triangular sectioned bristles 20 in the tufts 410, 510 may be such that these bristles have a stiffness approximating to that of the longer circular sectioned bristles 10 in tufts 411.

Figure 7:
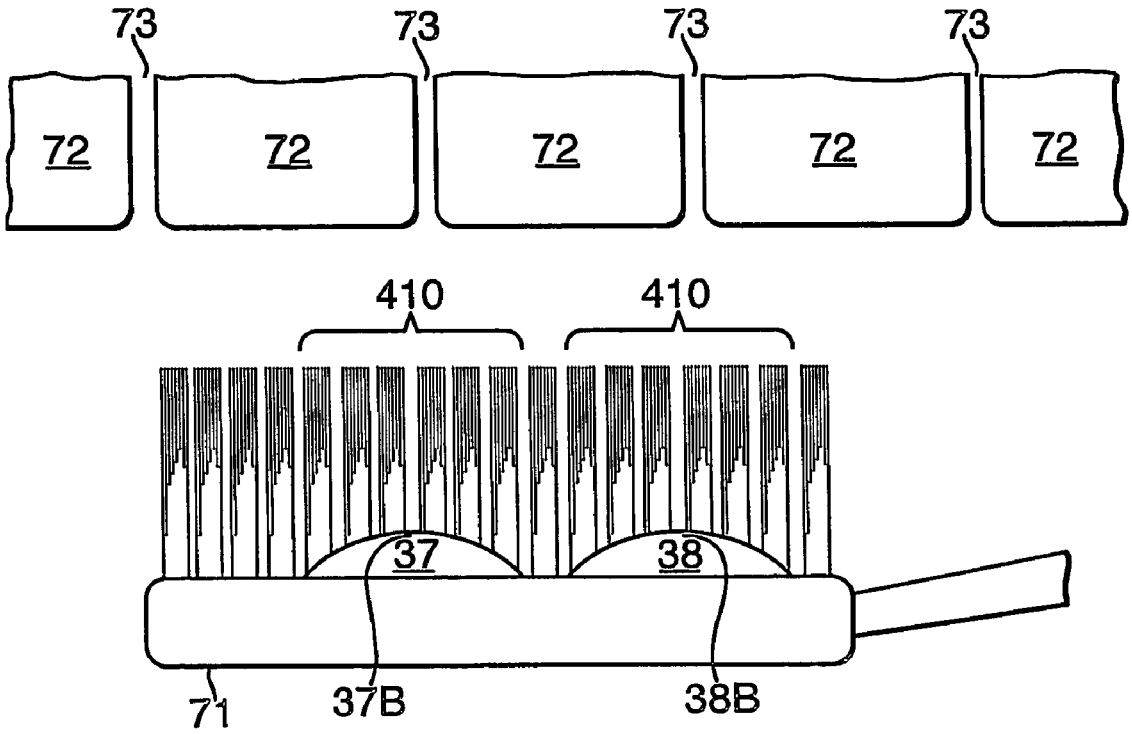
FIG. 7 Shows the use of the toothbrush head of the invention in cleaning teeth.

Referring to FIG. 7 a toothbrush head 71 as shown in FIG. 3 is shown in use cleaning a set of teeth 72. It is seen that the spacing between the most displaced parts 37B, 38B of the more displaced parts 37, 38 correspond to the spacing between the interproximal gaps 73 between the teeth 72, so that the short triangular sectioned bristles 410 on the more displaced parts 37, 38 are well positioned to penetrate the spaces 73.

Figure 8:
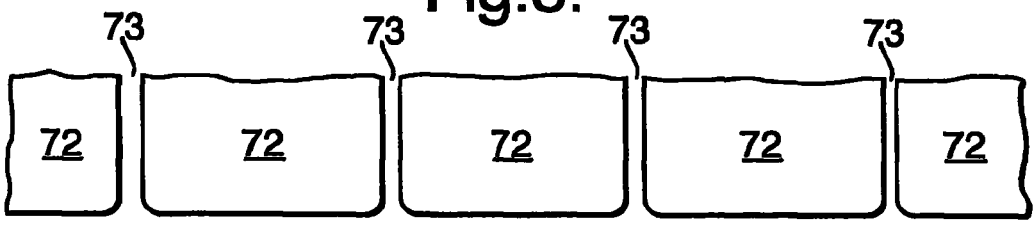
FIG. 8 Shows a sideways view of another toothbrush head of this invention.
Figure 8:
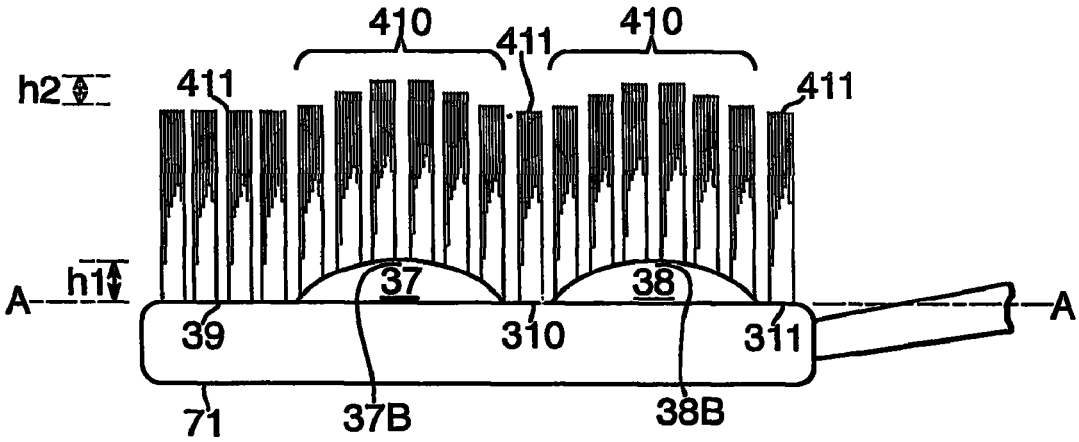

Referring to FIG. 8 a toothbrush head 81 is shown in a sideways view, having a construction generally corresponding to FIGS. 3 and 4. However in the toothbrush of FIG. 8 the bristles 410 extending from the more displaced parts 37 are shorter than the bristles 411 which extend from less displaced parts 39, 310, 311, to the extent that the ends of the bristles remote from the bristle face follow a profile having a convexity adjacent to the more displaced parts 37, 38. In this profile the length of the triangular sectioned bristles 410 extending from the more displaced parts 37, 38 is less than the length of the bristles 411 extending from the less displaced parts 39, 310, 311. This is achieved by the difference h2 between the displacement distance of the ends of the bristles 410 and 411 from the plane A—A being less than the difference h1 between the respective displacement distances of the less displaced parts 39, 310, 311 and more displaced parts 37, 38 from the plane A—A.

In the toothbrush head of FIG. 8, although the bristles 410 of triangular cross section have a cross section less than the bristles 411 of a round cross section extending from the less displaced parts 39, 310, 311, the shorter length of the bristles 410 than the longer bristles 411 can give the bristles 410 and 411 a similar stiffness, or the bristles 410 may even be more stiff than the bristles 411.

Figure 9:
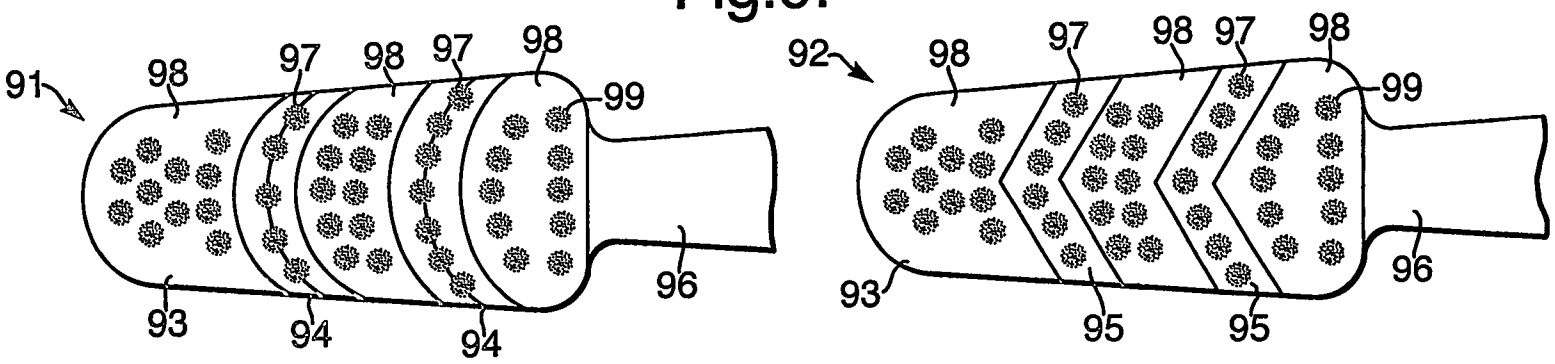
FIG. 9 Shows plan views of two more toothbrush heads of this invention.

Referring to FIG. 9 two plan views of toothbrush heads 91 and 92 are shown, looking down the bristle direction. The bristle face 93 of each head 91, 92 has two more displaced parts 94, 95. In the head 91 the more displaced parts 94 are in plan shape a curved crescentic shape with their cusps on opposite sides of the longitudinal axis of the head with their convex bulge facing away from the handle 96. In the head 92 the more displaced parts 95 are in plan shape a "V" or chevron shape with their apex pointing away from the handle 96. Tufts 97 in locations following the ridge line of the parts 94, 95 are composed of triangular sectioned bristles. In less displaced parts 98 are tufts 99 of bristles of a circular section. The side view of the toothbrush heads 91, 92 is almost identical to FIGS. 3 and 5.

Figure 10:
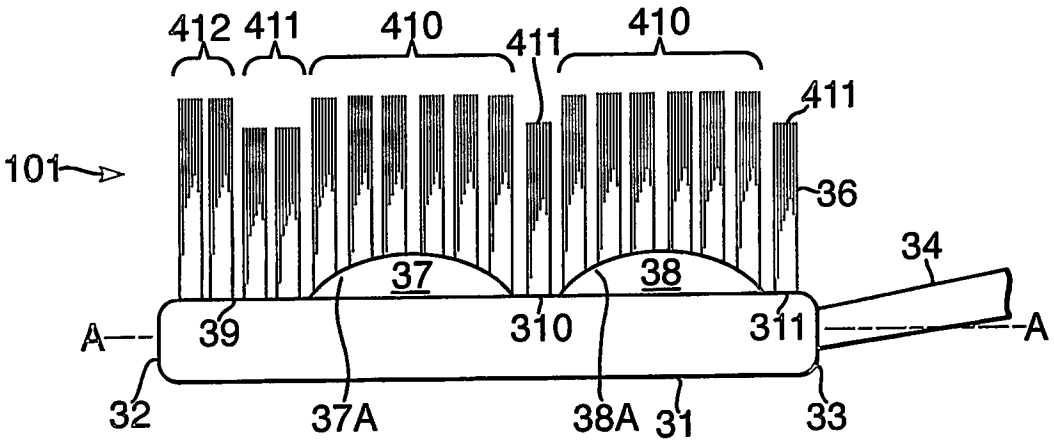
FIG. 10 Shows a sideways view of another toothbrush head of this invention.

Referring to FIG. 10 a side view of a toothbrush head 101 similar to that of FIG. 3 is shown, corresponding features being numbered correspondingly. However in FIG. 10 the ends of the bristles 36 remote from the bristle face occupy a longitudinally undulating profile. In FIG. 10 the undulating profile is one in which the ends of the bristles 36 occupy two height levels from the face. Tufts 412 and 410 have their ends at a first greater height from the bristle face, and tufts 411 have their ends at a second lower height from the bristle face. The longitudinal sequence of groups 412, 411, 410, 411, 410, 411 of tufts have their ends longitudinally alternatingly at the first or second height. Tufts 410 of the first height extend from the more displaced parts 37, 38, and tufts 411 of the second height extend from less displaced parts 39, 310, 311. Group of tufts 412 furthest from the handle have the first, greater height.

Figure 11:
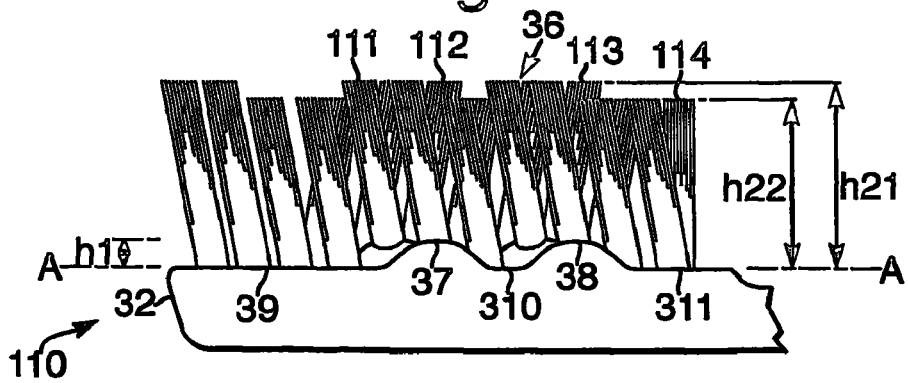
FIG. 11 Shows a sideways view of another toothbrush head of this invention.

Referring to FIG. 11 a toothbrush head 110 (the handle is omitted for clarity) with an arrangement of tufts similar to that of FIG. 10 is shown in side view. The difference h1 between the respective displacement distances of the less displaced parts 39, 310, 311 and more displaced parts 37, 38 from the plane A—A is ca. 1.6 mm. The more displaced parts 37, 38 are in plan crescent shaped as in FIG. 9. Also the tufts of bristles 36 are at a non-perpendicular angle to the bristle face and to the plane. The tufts 36 are arranged in longitudinally aligned rows of longitudinally sequential tufts, and the tufts 111 in one row lean so that their ends remote from the face are closer to the tip end 32, and tufts 112 in a widthways adjacent row lean in the opposite way, so that their ends remote from the face are further from the tip end 32. As seen looking across the longitudinal direction the widthways adjacent rows 111, 112 appear to cross in an "X" shape. In FIG. 11 the ends of the bristles 36 remote from the bristle face also occupy a longitudinally undulating profile similar to that shown in FIG. 10 in which the ends of the bristles 36 occupy a first greater height h21 with bristle ends 113 at 11 mm from the bristle face, and a second lower height h22 with ends 114 at 10 mm from the bristle face.

Figure 12:
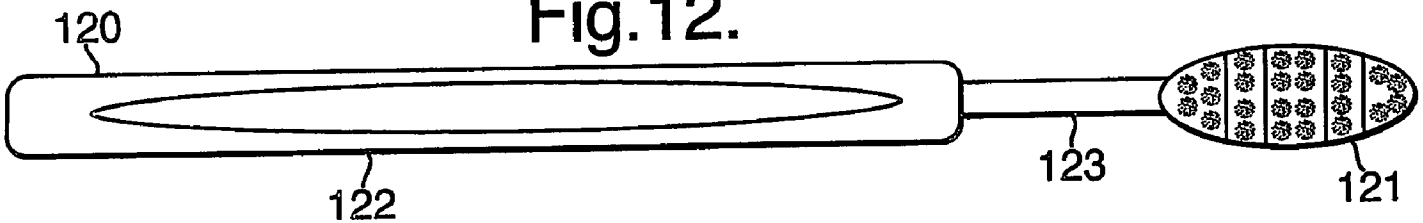
FIG. 12 Shows an overall plan view of a toothbrush of this invention.

Referring to FIG. 12 the overall arrangement of a toothbrush 120 overall of the invention is shown. The toothbrush 120 has a head 121, e.g. as shown in any of FIGS. 1-11. The toothbrush 120 has a handle 122 with a neck 123 longitudinally in between. The head 121 may be integrally connected with neck 123 or may be replaceable connectable to the handle 122.

An interproximal axis entry test was performed using a toothbrush with a head as shown in FIG. 11, and with a toothbrush with the same shaped head with the same shaped more and less displaced parts, but with all its bristles of circular cross-section. In the test pressure-sensitive paper was draped over teeth and the bristles were pressed against the teeth covered with pressure sensitive paper. Marks caused by the pressure of the bristle ends on the paper showed the depth of penetration of the bristles into the interdental spaces between the teeth, It was found that the triangular sectioned bristles of the toothbrush head of FIG. 11 penetrated deeper between the teeth than the circular-sectioned bristles of the comparison.

The invention claimed is:

1. A toothbrush head, connected to or connectable to a handle, and which is elongated along a head longitudinal direction and has a bristle face from which bristles extend in a bristle direction, the bristle face having an undulating surface that varies, with longitudinal distance along the head, in its displacement distance in a direction perpendicular to a plane passing through the head parallel to its longitudinal direction, so that there is at least one part more displaced from said plane and at least one part less displaced from said plane, and comprising an arrangement of said at least one part more displaced and at least one part less displaced which comprises: a first less displaced part adjacent the end of the head furthest from the handle, a first more displaced part longitudinally adjacent to this first less displaced part and closer to the handle, a second less displaced part longitudinally adjacent the first more displaced part and closer to the handle, a second more displaced part longitudinally adjacent to this second less displaced part and closer to the handle so that the second less displaced part is longitudinally between the first and second more displaced parts, and a third less displaced part longitudinally adjacent the second more displaced part and closest to the handle; and, wherein bristles having a triangular cross section extend only from the more displaced parts of the head.

2. The toothbrush head according to claim 1 having a more displaced part in the form of a ridge which in plan view looking down on the bristle face perpendicular to the longitudinal direction is a curved shape with its cusps on opposite sides of the longitudinal axis of the head, with its convex bulge facing away from the handle.

3. The toothbrush head according to claim 1 having a more displaced part in the form of a ridge which in plan view looking down on the bristle face perpendicular to the longitudinal direction is a "V" or chevron shape with its apex pointing away from the handle.

4. The toothbrush head according to claim 1 wherein the longitudinal spacing of the most displaced parts of such at least two more displaced parts corresponds approximately to the spacing between the interproximal spaces of adjacent teeth.

5. The toothbrush head according to claim 1 wherein the variation in displacement distance between more and less displaced parts is 1-3 mm.

6. The toothbrush head according to claim 1 wherein bristles having a round cross section extend from a less displaced part of the bristle face.

7. The toothbrush head according to claim 1 wherein the ends of the bristles remote from the bristle face occupy a longitudinally undulating profile.

8. The toothbrush head according to claim 7 wherein the ends of the bristles occupy two height levels from the face, being a first greater height and a second lower height, with groups of tufts having their ends longitudinally alternatingly at the first or second height.

9. The toothbrush head according to claim 8 wherein tufts of the first height extend from the more displaced parts, and tufts of the second height extend from less displaced parts.

10. The toothbrush according to claim 8 wherein tuft or group of tufts furthest from the handle has the first, greater height.

11. The toothbrush according to claim 8 wherein the bristles have a length 10-12 mm between the bristle face and the ends of the bristles, and the difference between the first and second height is 1.0-1.5 mm.

12. The toothbrush head according to claim 1 wherein bristles are at a non-perpendicular angle to the bristle face.

13. The toothbrush head according to claim 12 wherein bristles are in longitudinally aligned rows of longitudinally sequential tufts, and the tufts in one such row lean so that their ends remote from the face are closer to the tip end, and tufts in a widthways adjacent row may lean in the opposite way, so that as seen looking across the longitudinal direction the widthways adjacent rows appear to cross in an "X" shape.

14. A toothbrush having the toothbrush head as claimed in claim 1, and a grip handle, with a neck between the head and handle.

* * * * *